United States Patent [19]

Sakamoto et al.

[11] Patent Number: 4,851,038

[45] Date of Patent: Jul. 25, 1989

[54] METHOD FOR MANUFACTURING AGGLOMERATES OF FIRED PELLETS

[75] Inventors: Noboru Sakamoto; Hidetoshi Noda; Hideomi Yanaka, all of Tokyo, Japan

[73] Assignee: Nippon Kokan Kabushiki Kaisha, Tokyo, Japan

[21] Appl. No.: 131,660

[22] Filed: Dec. 11, 1987

[30] Foreign Application Priority Data

| | | | |
|---|---|---|---|
| Dec. 15, 1986 | [JP] | Japan | 61-296687 |
| Dec. 15, 1986 | [JP] | Japan | 61-296688 |
| Dec. 15, 1986 | [JP] | Japan | 61-206689 |
| Dec. 15, 1986 | [JP] | Japan | 61-296690 |
| Dec. 15, 1986 | [JP] | Japan | 61-298444 |
| Dec. 15, 1986 | [JP] | Japan | 61-296692 |
| Dec. 15, 1986 | [JP] | Japan | 61-296693 |
| Dec. 15, 1986 | [JP] | Japan | 61-298442 |
| Dec. 15, 1986 | [JP] | Japan | 61-298443 |
| Dec. 15, 1986 | [JP] | Japan | 61-296691 |

[51] Int. Cl.[4] ..... C22B 1/20

[52] U.S. Cl. ..... 75/5; 75/257

[58] Field of Search ..... 75/5, 257

[56] References Cited

U.S. PATENT DOCUMENTS

| | | | |
|---|---|---|---|
| 4,722,750 | 2/1988 | Saito et al. | 75/5 |
| 4,723,995 | 2/1988 | Satomi et al. | 75/5 |

FOREIGN PATENT DOCUMENTS 61-106728 5/1986 Japan .

*Primary Examiner*—Melvyn J. Andrews

*Attorney, Agent, or Firm*—Fleit, Jacobson, Cohn, Price, Holman & Stern

[57] ABSTRACT

A method for manufacturing agglomerates of fired pellets comprising the steps of: the first pelletization step of adding and mixing fluxes to fine iron ores containing 30 to 95 wt. % of those of 0.125 mm or less in particle size to form a mixture and to pelletize the mixture into green pellets; the second pelletization step of adding powder cokes containing 80 to 100 wt. % of those of 1 mm or less in particle size to the green pellets, in amount of 2.5 to 4.0 wt. % to the fine iron ores, to prepare, through pelletization, green pellets coated with the powder cokes; and the sintering step of charging the green pellets coated with the powder cokes into a grate type sintering machine to manufacture the agglomerates of fired pellets. And furthermore, in another method for manufacturing agglomerated of fired pellets, fine iron ores containing 10 to 80 wt. % of those of 0.044 mm or less in particle size and powder cokes containing 20 to 70 wt. % of those of 1 mm or less in particle size are used.

16 Claims, 9 Drawing Sheets

(%)
90
80
70
REDUCTION INDEX
0.5 1.0 2.0 3.0 4.0 5.0 6.0 (wt %)
SiO2 CONTENT IN AGGLOMERATES OF FIRED PELLETS (%)
30
20
REDUCTIVE PELLETIZING RATIO
0.5 1.0 2.0 3.0 4.0 5.0 6.0 (wt %)
SiO2 CONTENT IN AGGLOMERATES OF FIRED PELLETS (%)
90
85
80
SHATTER INDEX (SI + 5)
0.5 1.0 2.0 3.0 4.0 5.0 6.0 (wt %)
SiO2 CONTENT IN AGGLOMERATES OF FIRED PELLETS $SiO_2$ CONTENT IN AGGLOMERATES OF FIRED PELLETS

METHOD FOR MANUFACTURING AGGLOMERATES OF FIRED PELLETS

BACKGROUND OF THE INVENTION

1. Field of the Invention

The present invention relates to a method for manufacturing agglomerates of fired pellets fitted for materials used for a blast furnace or a direct reduction furnace, and more particularly, to conditions on materials used for manufacture of the agglomerates of fired pellets and conditions on pelletization of the materials.

2. Description of the Related Art

As materials used for a blast furnace or a direct reduction furnace, agglomerates of fired pellets, which are made from fine iron ores by pelletization and by sintering are well known. Consumption of these fired pellets are increasing in amount year by year, various research and development on these fired pellets has been performed. For example, a method is disclosed in a Japanese Patent Application Laid Open (KOKAI) No. 106728/86 to which a U.S. patent application Ser. No. 769624 corresponds, wherein:

(a) To fine iron ores mainly composed of those of 5 mm or less in particle size, fluxes are added, and the fine iron ores are pelletized, as the first step pelletization, into green pellets;

(b) the green pellets are coated on their surface, as the second step pelletization, with solid fuels such as powder cokes, powder chars, fine powder coals and powder oil cokes to prepare mini-pellets of 3 to 9 mm in particle size, providing that the addition ratio of the solid fuels is 2.5 to 3.5 wt. % to the fine iron ores;

(c) the mini-pellets are sintered, through a grate type sintering machine equipped with zones for drying, igniting, sintering and cooling, to prepare blocky agglomerates of mini-pellets;

(d) the agglomerates of mini-pellets manufactured by sintering are composed of mini-pellets combined on their surface through work of calcium ferrite.

This method, however, allows the following difficulties to remain still unsettled;

(1) The yield is low, and, consequently, the productivity is low.

(2) The strength of the agglomerates of mini-pellets is not satisfactory for the operation of a blast furnace and a direct reduction furnace.

SUMMARY OF THE INVENTION

It is an object of the present invention to provide a method for manufacturing agglomerates of fired pellets, enabling the productivity to be good enough and the strength to be strong enough for the operation of a blast furnace and a direct reduction furnace.

In accordance with the present invention, a method is provided for manufacturing agglomerates of fired pellets comprising the steps of:

the step, as the first pelletization, of adding and mixing fluxes to and with fine iron ores containing 30 to 95 wt. % of 0.125 mm or less fine iron ores in particle size to form a mixture, and to pelletize the mixture into green pellets;

the step, as the second pelletization, of adding powder cokes containing 80 to 100 wt. % of 0.1 mm or less powder cokes in particle size, to the green pellets, in amount of 2.5 to 4.0 wt. % to the powder-iron ores, to prepare, through pelletization, green pellets coated with the powder cokes; and the step, as sintering, of charging the green pellets coated with the powder cokes into a grate type sintering machine, to sinter the green pellets coated with powder cokes, thereby the agglomerates of fired pellets being produced.

Furthermore, a method is provided for manufacturing agglomerates of fired pellets comprising the steps of:

the step, as the first pelletization, of adding and mixing fluxes to and with fine iron ores containing 10 to 80 wt. % of 0.044 mm or less fine iron ores in particle size, to form a mixture and to pelletize the mixture into green pellets;

the step, as the second pelletization, of adding powder cokes containing 20 to 70 wt. % of 0.1 mm or less in particle size, to the green pellets, in amount of 2.5 to 4.0 wt. % to the fine iron ores, to prepare, through pelletization, green pellets with the powder cokes; and the step, as sintering, of charging the green pellets coated with the powder cokes into a grate type sintering machine, to sinter the green pellets coated with powder cokes, thereby the agglomerates of fired pellets being produced.

The object and the other objects and advantages of the present invention will become more apparent from the detailed description to follow, taken in conjunction with the appended drawings.

DESCRIPTION OF THE PREFERRED EMBODIMENT

Preferred Embodiment 1

Figure 1:
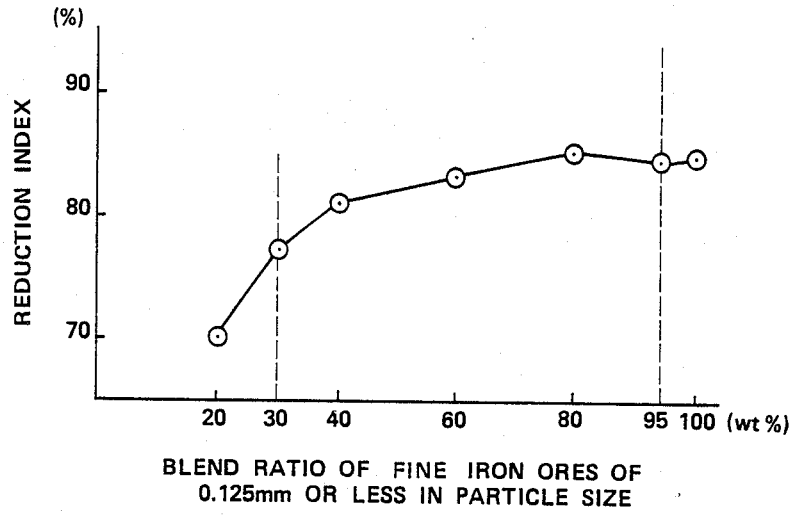
FIG. 1 is a graphic representation showing relation of blend ratio of 0.125 mm or less fine iron ores contained in those used of 8 mm or less in particle size, to reduction index of obtained agglomerates of fired pellets, according to a method of the present invention.

Now, a method for manufacturing fired pellets of the present invention will be described.

1.0 to 2.5 wt. % quick limes were added and mixed, as a flux, to fine iron ores containing 30 to 95 wt. % of those of 0.125 mm or less in particle size. Subsequently, a mixture thus prepared, was pelletized, by means of a disc type pelletizer, into 3 to 13 mm green pellets (the first pelletization). Further, powder cokes containing 80 to 100 wt. % of those of 1 mm or less in particle size were added to the green pellets, in amount of 2.5 to 4.0 wt. % to the fine iron ores, and the green pellets were pelletized again, by means of a drum type pelletizer into the green pellets coated with the powder cokes (the second pelletization). The green pellets coated with the powder cokes were charged into a grate type sintering machine to manufacture agglomerates of fired pellets composed of fired pellets combined in plurality.

Terms "Reduction index", "shatter index" and "reduction degradation index" herein contained, have meanings as defined herebelow throughout in this specification.

(1) Reduction index (RI):

The reduction index was measured by a method specified in JIS (Japanese Industrial Standards), which comprises: reducing the fired pellets in a an amount of 500 g charged into an experimental electric furnace by means of a reducing gas comprising 30 vol. % CO and 70 vol. % $N_2$ at a temperature of 900°C. for 180 minutes, and measuring the reduction index of the fired pellets.

(2) Shatter index ($SI_{+5}$):

The shatter index was measured by a method specified in JIS, which comprises: dropping the fired pellets in an amount of 20 Kg four times from a height of 2 m onto an iron plate, sieving the thus dropped fired pellets through a 5-mm mesh screen, and measuring the ratio of particles on the screen.

(3) Reduction degradation index (RDI):

The reduction degradation index was measured by a method specified by the Ironmaking committee of the Iron and Steel Institute of Japan, which comprises: reducing the fired pellets in an amount of 500 g charged into an experimental electric furnace by means of a reducing gas comprising 30 vol. % CO and 70 vol. % $N_2$ at a temperature of 550°C. for 30 minutes, receiving the thus reduced fired pellets in a drum, rotating the drum by 900 revolutions, sieving the fired pellets taken out from the drum through a 3-mm mesh screen, and measuring the ratio of particles under the screen.

Particle Size of Fine Iron Ores

Particle size of fine iron ores will be described in detail herebelow. The following conception occurred to those engaged in research and development:

(A) If blend ratio of powdery fine iron ores increases and fine iron ores to be used become smaller on average in particle size, then reduction index of fired pellets will be increased because many macro-pores are formed in each body of the fired pellets to be obtained when the fine iron ores are pelletized into green pellets.

(B) If fluxes are added to fine iron ores and the fine iron ores are pelletized into green pellets, then agglomerates of fired pellets will be strengthened in their shatter index because the green pellets, thus pelletized into, become high both in strength and density.

Figure 2:
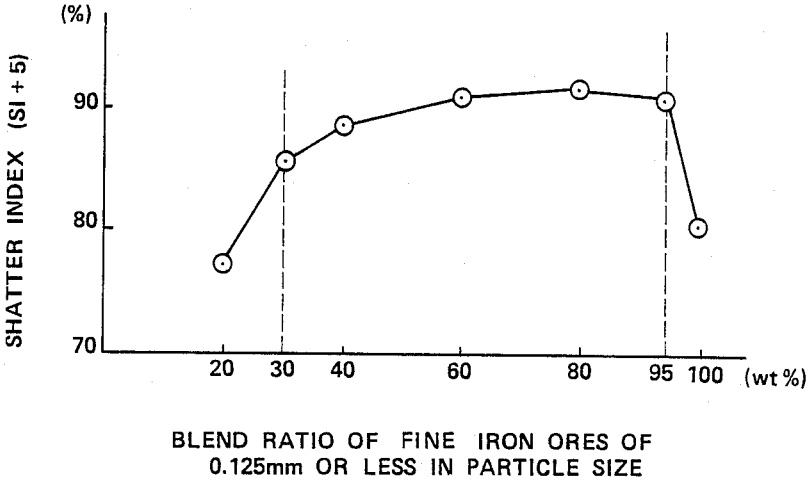
FIG. 2 is a graphic representation showing relation of blend ratio of 0.125 mm or less fine iron ores contained in those used of 8 mm or less in particle size, to shatter index of the obtained agglomerates of fired pellets, according to the method.

Based on this conception, an experiment was carried out wherein blend ratios of fine iron ores having various distribution of their particle sizes were varied to pelletize green pellets into agglomerates of fired pellets, and reduction indexes and shatter indexes of the agglomerates of fired pellets were checked. Fig. 1 of the drawing shows graphically relation of blend ratio of 0.125 mm or less fine iron ores contained in those of 8 mm or less in particle size, to reduction index of obtained agglomerates of fired pellets. FIG. 2 graphically shows relation of blend ratio of 0.125 mm or less fine iron ores included in those of 8 mm or less in particle size, to shatter index of the obtained agglomerates of fire pellets. As shown in FIG. 1, because macro-pores contained in each body of fired pellets increase as the blend ratio of 0.125 mm or less in particle size are increasing, reduction index of the agglomerates of fired pellets is improved. When the blend ratio of fine iron ores is 30 wt. % or more, the reduction index is high enough to be well more than 75%. As shown in FIG. 2, if the blend ratio of 0.125 mm or less fine iron ores is 30 wt. % or more, the density and strength of the green pellets are increased so high as to allow the shatter index of the obtained agglomerates of fired pellets to show more than 85%. However, if the blend ratio becomes 95 wt. % or more, green pellets get apt to be melted through excessive heating and to form glassy slag, this resulting in rapid deterioration of the shatter index. From the results of the experiment, it became apparent that if powder iron ores consisting of 30 to 95 wt. % of those of 0.125 mm or less in particle size and of the rest of those more than 0.125 mm are used, then the reduction index and the shatter index of the agglomerates of fired pellets will be preferably by far improved. The range of 50 to 95 wt. % of powder iron ores of 0.125 mm or less is more preferable.

Powder Cokes

Powder cokes to be added at the step of the second pelletization will now be explained about. The concept thereof was made as shown herebelow.

(A) If particle size becomes relatively fine, powder cokes will be allowed to coat the surface of green pellets fully and uniformly.

(B) If the green pellets are sintered, in good condition, in a sintering machine, improvement in yield and productivity of the fired pellets will be able to be attained.

Figure 3:
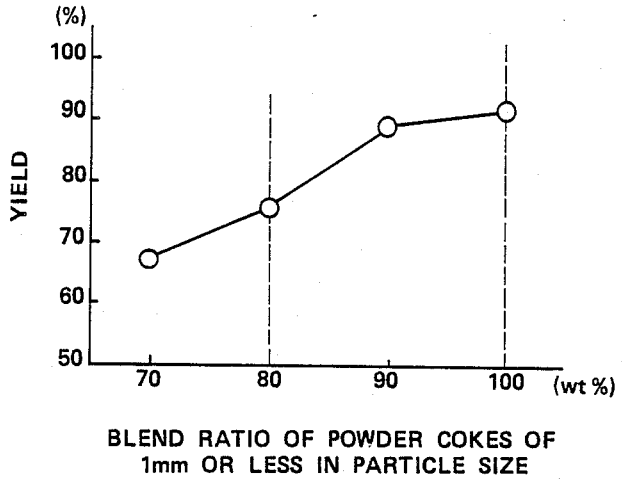
FIG. 3 is a graphic representation showing relation of blend ratio of 1 mm or less powder cokes contained in those, used for coating green pellets, of 5 mm or less in particle size, to yield of the obtained agglomerates of fired pellets, according to the method.
Figure 4:
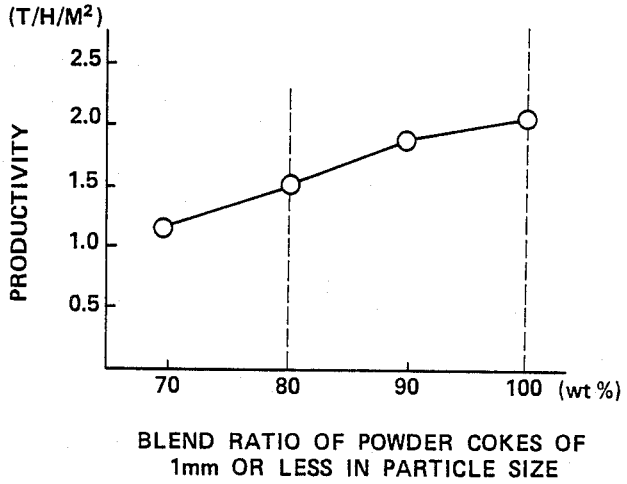
FIG. 4 is a graphic representation showing relation of blend ratio of 1 mm or less powder cokes contained in those of 5 mm or less in particle size, to productivity of the obtained agglomerates of fired pellets, according to the method.

According to this way of thinking, an experiment was carried out, wherein green pellets were coated with various particle sizes of powder cokes and various blend ratios thereof to manufacture agglomerates of fired pellets, and shatter indexes and productivities of the agglomerates of fired pellets corresponding to the variation were checked. FIG. 3 graphically shows relation of blend ratio of 1 mm or less powder cokes contained in those of 5 mm or less in particle size, to the yield of the obtained agglomerates of fired pellets. FIG. 4 graphically shows relation of blend ratio of 1 mm or less powder cokes contained in those of 5 mm or less in particle size, to the shatter index of the obtained agglomerates of fired pellets. In this experiment, fine iron ores used were of 8 mm or less in particle size, green pellets of 3 to 13 mm, and the powder cokes were added in amount of 3.5 wt. %. As seen from FIG. 3, the more the blend ratio of 1 mm or less powder cokes becomes, the better green pellets get coated and sintered, this resulting in improving the yield. If the blend ratio is 80 wt. % or more, the yield is high enough to show 75% or more. As seen from Fig. 4, the productivity also increases, as the blend ratio is going up. In the range of 80 wt. % or more of the blend ratio, the productivity is good enough to mark 1.5 $T/H/M^2$ or more. Consequently, the blending ratio of 1 mm or less powder cokes ranges preferably 80 to 100 wt. %. To further improve the yield and the productivity, it is more preferable to keep the blending ratio of 1 mm or less powder cokes in the range of 90 to 100 wt. %. The amount of powder cokes for coating the green pellets are recommended to be 2.5 to 4.0 wt. % to the amount of fine iron ores. If the amount of the powder cokes for coating is less than 2.5 wt. %, it is impossible to sinter the green pellets into fired pellets of high shatter index in a short time, namely, efficiency in sintering the green pellets in a sintering machine cannot be raised. Contrarily, if the amount of the powder cokes for coating is over 4.0 wt. %, the temperature at the time of sintering the green pellets rises excessively so high that the agglomerates of fired pellets becomes too dense in their texture.

The Second Pelletization

The reasons for a drum type pelletizer being preferably fitted for coating green pellets with powder cokes will be explained herebelow.

In a pelletizer of drum type, its inclined drum rotates and, therefore, green pellets can be pushed out, almost equally regardless of their particle sizes, through the end of the drum. Consequently, the green pellets are discharged almost without difference in their retention time in the pelletizer. Due to this performance, in a case, for example, that 3 to 13 mm green pellets in particle size are coated with powder cokes, the green pellets are allowed to be successfully covered without dispersion of coating amount. Even in the case of using large size green pellets, there is no shortage of coating amount. Therefore, even in the lower layer portion where larger green pellets in particle size are easy to gather when charged into a sintering machine, the sintering works so well that there is no occurence of deterioration either in yield of the agglomerates of fired pellets, or in productivity due to prolonging sintering time. If powder cokes are coated with by means of a disc type pelletizer which is customarily used, time during which green pellets stay in the disc pelletizer is different, depending on their particle sizes. Due to the difference of the retention time, coating amount of power cokes per unit weight of green pellets are dispersed, and, thus, shortage of coating amount covering green pellets occurs. Owing to this, in the lower layer portion which is easy to allow large size green pellets to gather in charging them into the sintering machine, the sintering does not work well. This results in deterioration either in yield of the agglomerates fired pellets or in productivity thereof because of sintering time becoming longer.

Addition of Quick Limes

Figure 5:
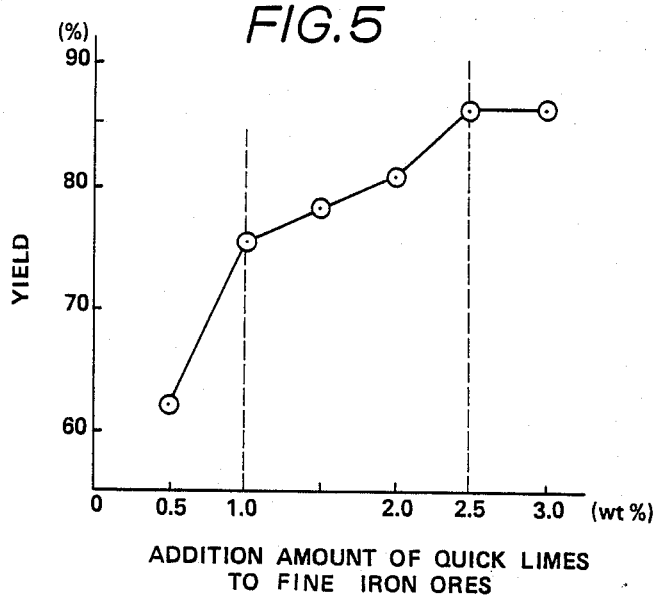
FIG. 5 is a graphic representation showing relation of quick lime addition amount to fine iron ores, to yield of the obtained agglomerates of fired pellets, according to the method.
Figure 6:
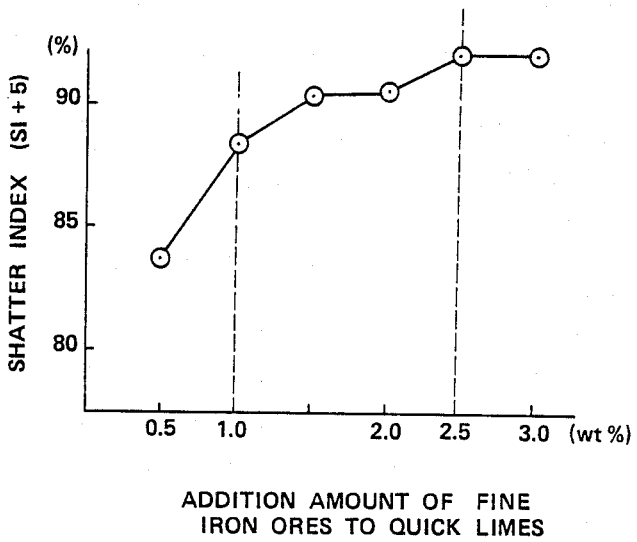
FIG. 6 is a graphic representation showing relation of quick lime addition amount to fine iron ores, to the shatter index, according to the method.

According to the method of the present invention, fine iron ores were pelletized by use of a disc type pelletizer and only with addition of fluxes, and, thereafter, coating with powder cokes was made. From this performance, it became apparent that this method was so good for pelletization of fine iron ores that green pellets could be obtained from fine iron ores with addition of quick limes in small amount. But, owing to this addition amount being small, there remained the possibility of deteriorating the yield and the shatter index. In this connection, an experiment was carried out wherein various amount of quick limes were added to manufacture fired pellets by means of sintering green pellets pelletized through the addition of quick limes to fine iron ores. FIG. 5 graphically shows relation of quick lime addition amount to fine iron ores, to yield of the agglomerates of fired pellets. FIG. 6 graphically shows relation of quick lime addition amount to shatter index of the agglomerates of fired pellets. In this experiment, fine iron ores were of 8 mm or less in particle size, green pellets of 3 to 13 mm, and powder cokes were added in amount of 3.5 wt. %.

As shown in FIG. 5, the more the addition amount of quick limes to fine iron ores increases, the better the yield of the obtained agglomerates of fired pellets is improved. When the addition amount is 1.0 wt. % or more, the yield marks 75% or more. In the case that the addition amount is over 2.5 wt. %, it can be admitted that the yield becomes 85% or more, but the growth of the yield is smaller in proportion, i.e. the increase of quick lime addition amount, after all, extends aspects of demerits. As recognized from FIG. 6, as the addition amount is going up, the shatter index increases. If the addition amount is 1.0 wt. % or more, the shatter index gets well over 85%. In the case that the addition amount is 2.5 wt. % or more, the shatter index becomes well over 90%, but the growth of shatter index is smaller in proportion.

Judging from the results, to maintain the yield of the obtained agglomerates of fired pellets 75% level or more and, at the same time, the shatter index more than 85%, and still to allow the addition amount of quick limes to be as small as possible, it is preferable that the quick lime addition amount ranges 1.0 to 2.5 wt. %. Note that fluxes together with quick limes are, of course, added to fine iron ores so as to keep $CaO/SiO_2$ ratio 1.0 to 2.5.

Particle Size of Green Pellets

If blend ratio of small green pellets increases and green pellets to be used become relatively small, yield of agglomerates of fired pellets can be expected to be improved, since sintering of green pellets are well performed. But, if blend ratio of small green pellets become excessive, at the time of sintering, permeability among the green pellets is deteriorated so much that, owing to long time being required for the sintering, the productivity is deteriorated. Furthermore, because the green pellets are apt to be melted when excessively heated, they form glassy slag. Consequently, this results in deterioration of the shatter index. Beside that, this increases melted texture portion. Therefore, there further remains danger of deteriorating reduction index and reduction degradation index of the agglomerates of fired pellets. In this connection, an experiment was carried out, wherein particle sizes and blend ratios of green pellets were varied, and the green pellets were coated with powder cokes to manufacture agglomerates of fired pellets.

Figure 7:
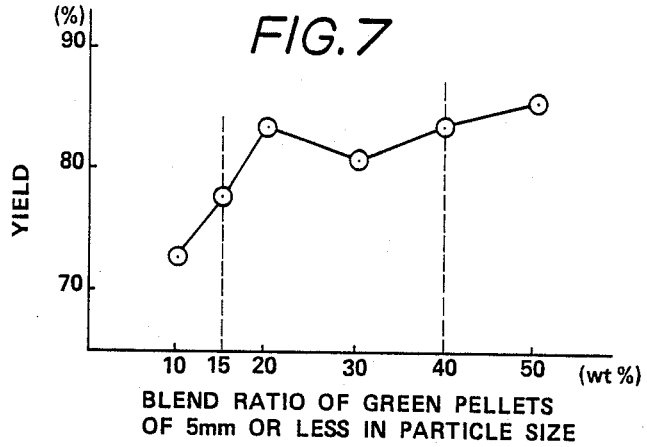
FIG. 7 is a graphic representation showing relation of blend ratio of 5 mm or less green pellets in particle size contained in those used, to the yield, according to the method.
Figure 8:
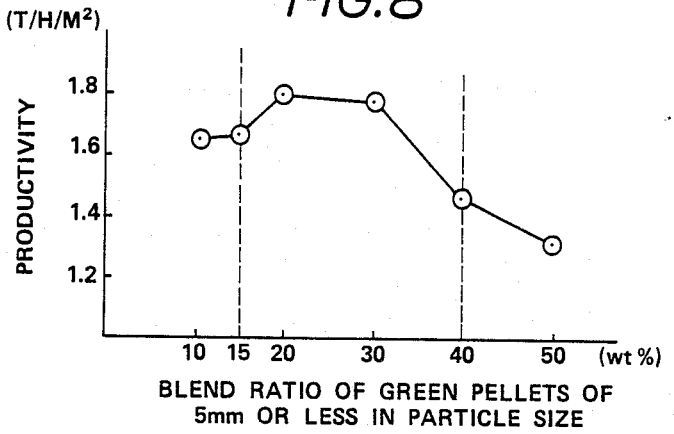
FIG. 8 is a graphic representation showing relation of blend ratio of 5 mm or less green pellets contained in those used, to the productivity, according to the method.
Figure 9:
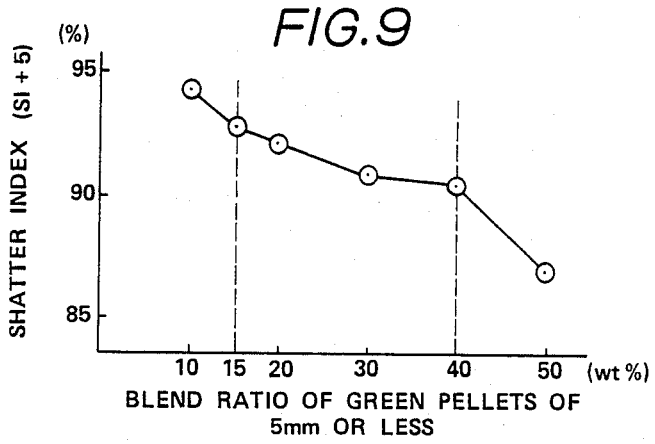
FIG. 9 is a graphic representation showing relation of blend ratio of 5 mm or less green pellets contained in those used, to the shatter index, according to the method.

FIG. 7 graphically shows relation of blend ratio of 5 mm or less green pellets included in those used to yield of the obtained agglomerates of fired pellets. FIG. 8, also, graphically shows relation of blend ratio of 5 mm or less green pellets included in those used to productivity of the obtained agglomerates of fired pellets. FIG. 9, also, graphically shows relation of blend ratio of 5 mm or less green pellets included in those used to shatter index of the agglomerates of fired pellets. In this experiment, 8 mm or less fine iron ores in particle size were used and 3.5 wt. % powder cokes were added.

As shown in FIG. 7, the more the blend ratio of 5 mm or less green pellets in particle size increases, the better the sintering performance of the green pellets becomes, and, thus, the yield of the agglomerates of fired pellets is improved. If the blend ratio is 15 wt. % or more, the yield is 78% or more. The productivity is, as seen in FIG. 8, maintaining the level of 1.5 $T/H/M^2$ or more so far as the blend ratio of the green pellets is 40 wt. % or less, while the productivity goes down to less than 1.5 $T/H/M^2$ when the blend ratio is over 40 wt. %, since in this range, owing to deterioration of permeability, sintering time becomes long. With respect to the shatter index of the agglomerates of fired pellets, as shown in FIG. 9, the more the blend ratio of 5 mm or less green pellets becomes, the more the shatter index is deteriorated, since glassy slag of the green pellets increase in proportion with the increase of the blend ratio. If the blend ratio is over 40 wt. %, the shatter index is less than 90%.

Accordingly, in order to keep the yield 78% or more, the productivity $1.5T/H/M^2$ level or more and the shatter index more than 90%, it is preferable to use green pellets consisting of 15 to 40 wt. % of 5 mm or less green pellets in particle size and the rest of those of more than 5 mm in particle size. 20 to 30 wt. % of 5 mm or less is more preferable.

$SiO_2$ Content in Agglomerates of Fired Pellets

Figure 10:
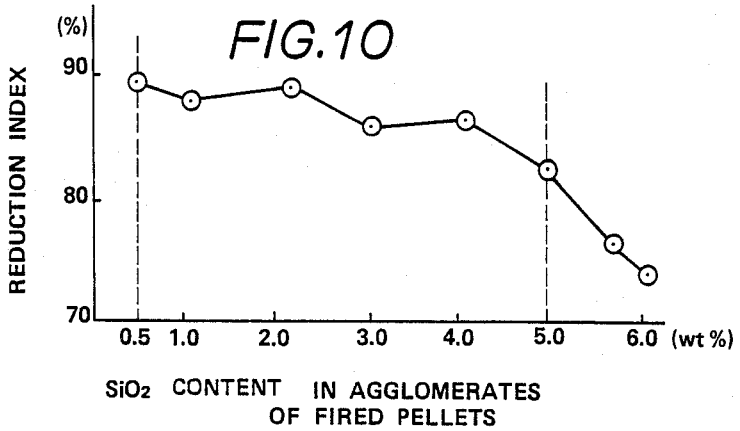
FIG. 10 is a graphic representation showing relation of $SiO_2$ content in the obtained agglomerates of fired pellets, to reduction index of the obtained agglomerates of fired pellets, according to the method.
Figure 11:
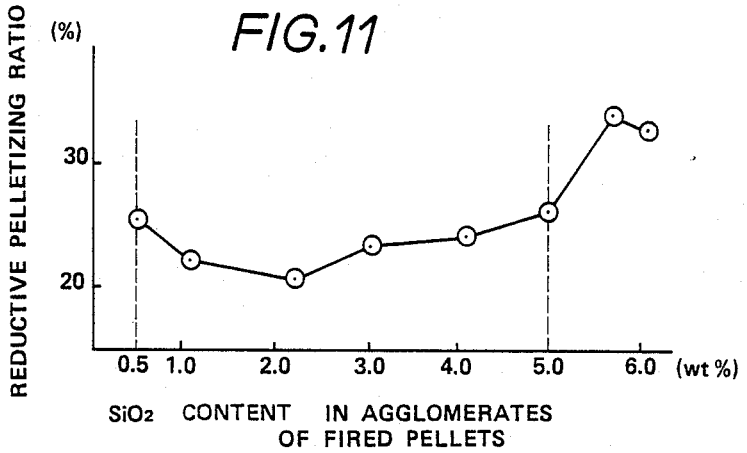
FIG. 11 is a graphic representation showing relation of $SiO_2$ content in the obtained agglomerates of fired pellets, to reduction degradation index, according to the method.
Figure 12:
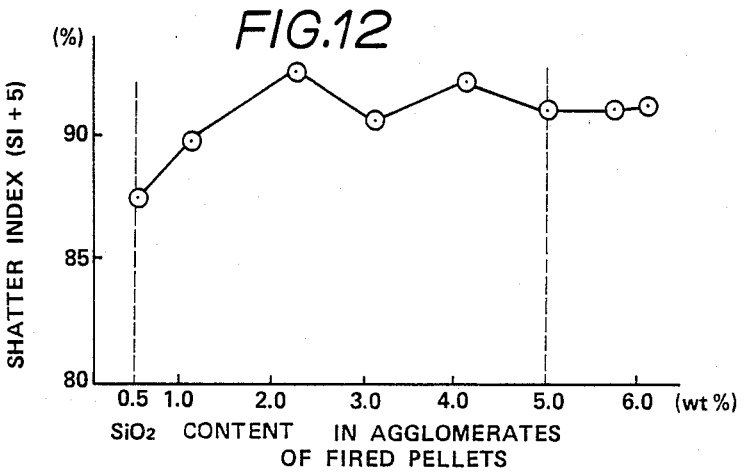
FIG. 12 is a graphic representation showing relation of $SiO_2$ content in the obtained agglomerates of fired pellets, to the shatter index according to the method.
Figure 13:
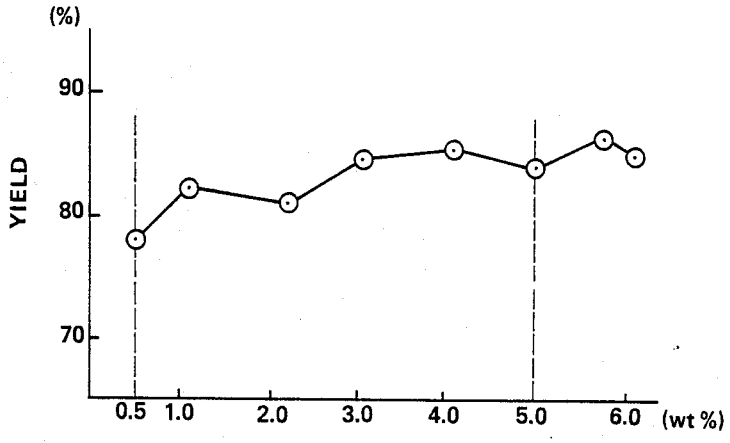
FIG. 13 is a graphic representation showing relation of $SiO_2$ content in the manufactured agglomerates of fired pellets, to the yield, according to the method.

According to the method of the present invention, fine iron ores are pelletized by use of a disc type pelletizer and only with addition of fluxes, and, thereafter, coating with powder cokes is made, and, resultantly, this method is good for the pelletization enough to form good spherical green pellets. Therefore, from the performance of this method, it was found that, during the process of sintering green pellets, $SiO_2$ contained in fine iron ores and CaO contained in fluxes reacted each other, although the $SiO_2$ content was small, to form slag and thereby to allow the fine iron ores to one another be combined and well agglomerated. In this connection, agglomerates of fired pellets of various $SiO_2$ contents were manufactured experimentally from green pellets which had been prepared from fine iron ores having various $SiO_2$ contents. In this experiment, relations of $SiO_2$ content in agglomerates of fired pellets, respectively, to reduction index, reduction degradation index, yield, and shatter index were pursued. FIG. 10 graphically shows relation of $SiO_2$ content in obtained agglomerates of fired pellets to their reduction index. FIG. 11 graphically shows relation of $SiO_2$ content in the obtained agglomerates of fired pellets to their reduction degradation index. FIG. 12 graphically shows relation of $SiO_2$ content in the obtained fired pellets to their shatter index. Fig. 13 graphically shows relation of $SiO_2$ content in the obtained agglomerates of fired pellets to their yield.

The reduction index of the agglomerates of fired pellets, as shown in FIG. 10, goes down as the $SiO_2$ content in the agglomerates of fired pellets is increasing. The reduction index, however, maintains the level higher than 80% in the $SiO_2$ content range of 0.5 to 5.0 wt. %. If the $SiO_2$ content is over 5.0 wt. %, the reduction index remarkably goes down. The reduction degradation index of the agglomerates of fired pellets, as seen from FIG. 11, shows good mark of less than 30% in the $SiO_2$ content range of 0.5 to 5.0 wt. %. If the $SiO_2$ content is less than 0.5 wt. %, the reduction degradation index is deteriorated, while if the $SiO_2$ content is over 5.0 wt. %, the reduction degradation index becomes worse over 30%. Furthermore, as shown in FIG. 12, the shatter index of the agglomerates of fired pellets keeps the level enough to be more than 85% also in the $SiO_2$ content range of 0.5 to 5.0. wt. %. If the $SiO_2$ content is less than 0.5 wt. %, the shatter index rapidly declines. With respect to the yield of the agglomerates of fired pellets, as shown in FIG. 13, the yield increases as the $SiO_2$ content is going up, and the yield satisfies the level of being well more than 75% even in the $SiO_2$ content range of 0.5 to 5.0 wt. %. If the $SiO_2$ content is lowered less than 0.5 wt. %, the yield rapidly declines.

Judging from these results, in order to keep the reduction index of more than 80% and the reduction degradation index of 30% or less without deterioration of the yield and the shatter index, the $SiO_2$ content of the agglomerates of fired pellets preferably ranges 0.5 to 5.0 wt. %. 1.0 to 4.0 wt. % of the $SiO_2$ content is more preferable.

Preferred Embodiment 2

Another embodiment of a method for manufacturing agglomerates of fired pellets according to the present invention will now be described.

Fine iron ores containing 10 to 80 wt. % of those of 0.044 mm or less in particle size were mixed with 1.0 to 2.5 wt. % quick limes added thereto, as a flux, to prepare a mixture. Subsequently, the prepared mixture was pelletized by means of a disc type pelletizer into green pellets of 3 to 13 mm in particle size (the first pelletization). Furthermore, powder cokes containing 20 to 70 wt. % of those of 0.1 mm or less in particle size were added to the green pellets, in amount of 2.5 to 4.0 wt. % to the fine iron ores, and the fine iron were pelletized, again, by means of a disc type pelletizer to the green pellets coated with the powder cokes (the second pelletization). The green pellets coated with the powder cokes were charged into a grate type sintering machine to manufacture agglomerates of fired pellets composed of fired pellets combined in plurality.

Particle Size of Fine Iron Ores

Figure 14:
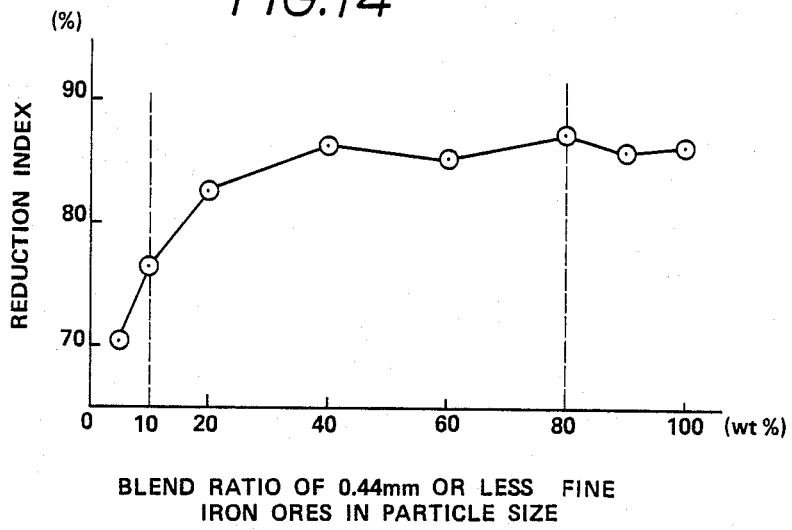
FIG. 14 is a graphic representation showing relation of blend ratio of 0.044 mm or less fine iron ores contained in those used of 8 mm or less in particle size, to the reduction index, according to the method.
Figure 15:
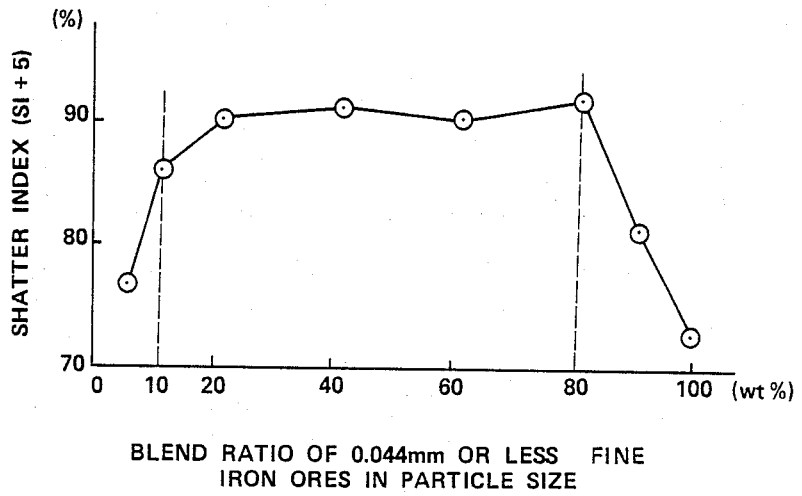
FIG. 15 is a graphic representation showing relation of blend ratio of 0.044 mm or less fine iron ores contained in those used of 8 mm or less in particle size, to the shatter index, according to the method.

An experiment was carried out wherein blend ratio of particle sizes of fine iron ores was varied to manufacture pelletized green pellets into agglomermates of fired pellets, and reduction index and shatter index of the agglomerates fired pellets were checked. FIG. 14 graphically shows relation of blend ratio of 0.44 mm or less fine iron ores contained in those used of 8 mm or less in particle size to reduction index of the obtained agglomerates of fired pellets. FIG. 15 graphically shows relation of blend ratio of 0.044 mm or less fine iron ores contained in those used of 8 mm or less in particle size, to shatter index of the agglomerates of fired pellets. As shown in FIG. 14, because macro pores contained in each body of fired pellets increase in proportion to the blend ratio of 0.044 mm or less fine iron ores in particle size, the reduction index is improved. When the blend ratio is 10 wt. % or more, the reduction index is high enough to be more than 75%. Next, as seen from FIG. 15, the blend ratio is over 10 wt. %, the density and the strength of the green pellets are improved so high as to allow the shatter index to be well over 80%. But, if the blend ratio is more than 80 wt. %, the following disadvantages occure:

(a) The green pellets get easy to bring about bursting at ignition, and, owing to permeability through layers of the green pellets getting poor, the drying time is required to be longer.

(b) The green pellets get easy to melt when excessively heated, and forms glassy slag. This results in deteriorating the shatter index of the agglomerates of fired pellets rapidly.

Seeing those mentioned, the fine iron ores consisting of 10 to 80 wt. % of those of 0.044 mm or less in particle size and the rest of those more than 0.044 mm are preferably used to improve by far the reduction index and the shatter index of the agglomerates of fired pellets. 20 to 80 wt. % of those of 0.044 mm or less in particle size is more preferable.

Powder Cokes

An experiment was carried out wherein particle sizes of powder cokes and blend ratios of the particle sizes were varied to coat green pellets therewith and to manufacture agglomerates of fired pellets. In this experiment, the yield and the shatter index of the manufactured agglomerates of fired pellets were checked.

Figure 16:
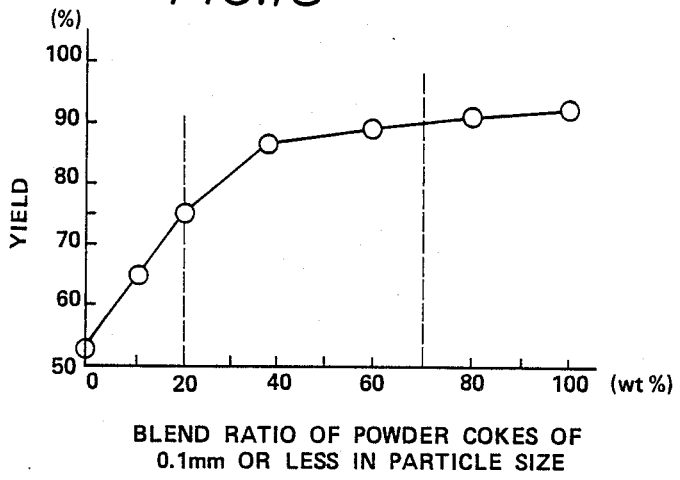
FIG. 16 is a graphic representation showing relation of blend ratio of 0.1 mm or less powder cokes contained in those of 5 mm or less used for coating green pellets, to the yield, according to the method.
Figure 17:
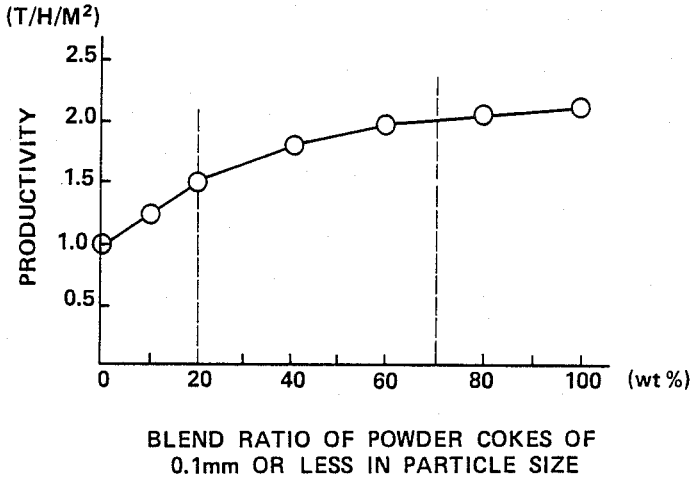
FIG. 17 is a graphic representation showing relation of blend ratio of 0.1 mm or less powder cokes contained in those of 5 mm or less, to the productivity, according to the method.

FIG. 16 graphically shows relation of blend ratio of 0.1 mm or less powder cokes contained in those of 5 mm or less in particle size for coating green pellets, to yield of obtained agglomerates of fired pellets. Fig. 17 graphically shows relation of blend ratio of 0.1 mm or less powder cokes contained those of 5 mm or less in particle size to productivity of the obtained agglomerates of fired pellets. In this experiment, fine iron ores were of 8 mm or less in particle size, green pellets of 3 to 13 mm and powder cokes were added in amount of 3.5 wt. %.

The green pellets get better coated with green pellets and sintered, as the blend ratio of 0.1 mm or less powder cokes is increasing. This results in improving the yield of the agglomerates of fired pellets, as shown in FIG. 16. Moreover, if the blend ratio is 20 wt. % or more, the yield is high enough to be 75% or more. When the blend ratio is over 70 wt. %, the yield exceeds 90%, but the growth of the yield is small. In other words, the cost for pulverizing cokes gets expensive in vein. The productivity also is improved more, as shown in FIG. 17, in proportion to the increase of the blend ratio. In the blend ratio range of 20 wt. % or more, the productivity is high enough to be $1.5/T/H/M^2$ or more. Furthermore, if the blend ratio is over 70%, the productivity exceeds $2.0/T/H/M^2$, but the growth of the productivity is small, considering the increase of the blend ratio.

Consequently, the blend ratio of 0.1 mm or less powder cokes in particle size ranges preferably 20 to 70 wt. %. To improve further the yield and the productivity, 40 to 70 wt. % of the blend ratio of 1 mm or less powder cokes in particle size is more preferable.

Preferred Embodiment 3

With specific reference to FIG. 18 of the drawing, another embodiment of coating green pellets with powder cokes according to a method of the present invention will now be described.

Figure 18:
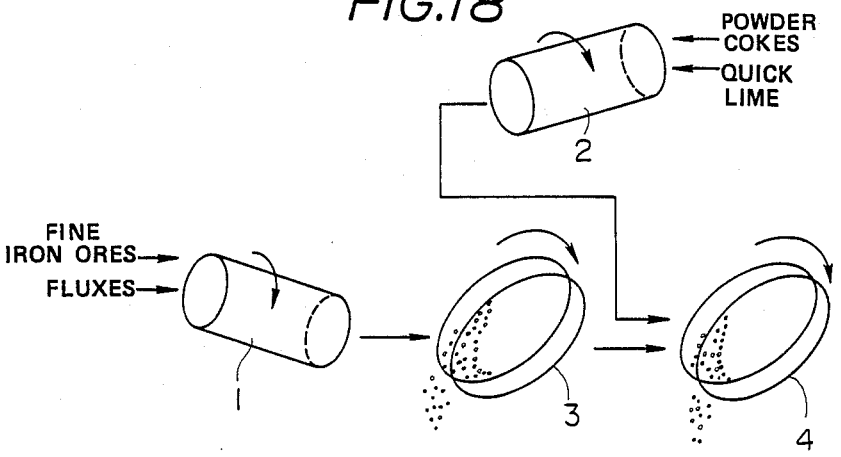
FIG. 18 is a schematic flow chart showing another example of a process of coating green pellets with powder cokes, according to the method.

In FIG. 18, referential numeral 1 denotes a first mixer of drum type, 2 a second mixer of drum type, 3 a first pelletizer of disc type and 4 a second pelletizer of disc type. In this embodiment, green pellets to have been pelletized into green pellets by means of first pelletizer 3 are coated with powder cokes which have already been mixed, by means of the second mixer, with binder added to the powder cokes, thereby to coat the surface of the green pellets well with the powder cokes.

Fine iron ores of 8 mm or less in particle sizes and fluxes are introduced into the first mixer, and mixed to form a mixture. The mixture is pelletized, with addition of water, into green pellets of 3 to 13 mm in particle size. The pelletized green pellets are introduced into second pelletizer 4. In the second pelletizer, the green pellets are pelletized again with addition of the powder cokes in amount of 2.5 to 4.0 wt. % which are supplied from the second mixer, thereby the green pellets being coated with the powder cokes. The powder cokes supplied from the second mixer have already mixed with binder added thereto in the second mixer. Resultantly, thanks to the effect of the binder, the powder cokes coat well the surface of the green pellets when the green pellets are pelletized. For this reason, even coarse powder cokes stick so well to the green pellets that even cokes of relatively coarse grains can coat well the surface of the green pellets.

Quick lime can be alternated by slacked lime, bentonite, dolomite, blast furnace water-granulated slag. Addition amount of the binder to powder cokes ranges preferable 0.1 to 1.0 wt. %. If the addition amount of a binder is less than 0.1 wt. %, effect in allowing powder cokes to well coat is small, while if the addition amount is over 1.0 wt. %, the cost of binder gets expensive, considering the increase in the effect of coating performance. When $CaO/SiO_2$ ratio of agglomerates of fired pellets is out of a designated range by addition of binder, addition amount of fluxes to fine iron ores is to be reduced as it may be required. Note that second mixer 2 is not necessarily of drum type and can be alternated by any device capable of mixing powder cokes with binder.

Preferred Embodiment 4

With specific reference to FIG. 19 of the drawing, another embodiment further according to a method of the present invention will now be described.

Figure 19:
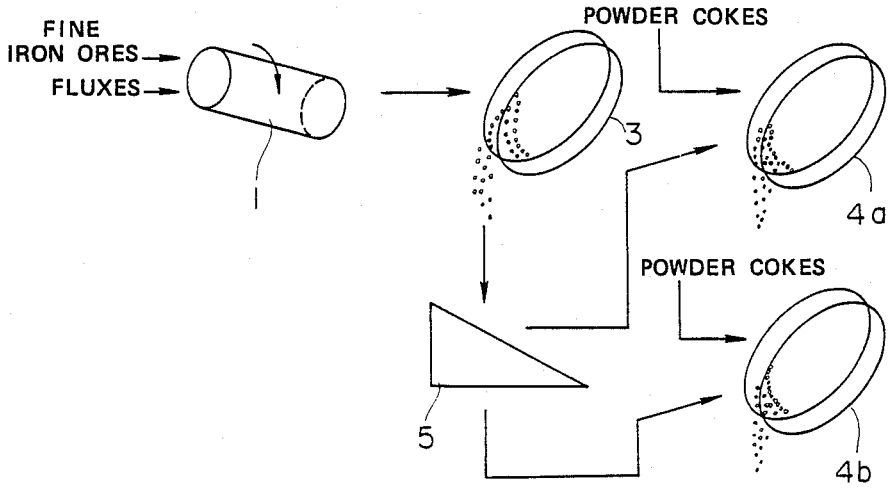
FIG. 19 is a schematic flow chart showing further another example of the process.

In FIG. 19, referential numeral 1 denotes a mixer of drum type, 3 a first pelletizer of disc type, 4*a* and 4*b*, each, second pelletizers of disc type and 5 screen device. In this experiment, green pellets pelletized into by first pelletizer 3, are screened into groups, for example, two groups, depending on particle sizes, so as to allow powder cokes to be added, by weighing an addition amount, more to a group of larger green pellets and to be mixed therewith through each of second mixers 4*a* and 4*b*. This is to allow a group composed of larger green pellets in particle size to be well coated.

Fine iron ores of 8 mm or less in particle size and fluxes are introduced into the first mixer and mixed to form a mixture. The mixture is introduced into first pelletizer 3 and pelletized with water addition into green pellets of 3 to 13 mm in particle size. Subsequently, the green pellets are screened by screen device 5 in groups, for example, one group consisting of larger green pellets more than 7 mm to 13 mm or less in particle size and another group of smaller green pellets 3 mm and more to 7 mm or less. The green pellets of the larger size group are transferred into second pelletizer 4*a*, and the green pellets of the other group into second pelletizer 4*b*. The green pellets respectively sent, are coated, on their surface, with powder cokes again added thereto in each of second pelletizer 4*a* and 4*b*.

In second pelletizer 4*a* and 4*b*, powder cokes are prepared in amount of 2.5 to 4.0 wt. % of green pellets totally to be coated, and are added to green pellets of the larger size group more than those of the other group by means of giving weight differently to addition amounts of the powder cokes to each of the two groups. This weighing is performed in such a manner as, for example, when 3.5 wt. % powder cokes are totally added to the green pellets, those of 4.0 to 4.5 wt. % of the green pellets of the larger size group are added thereto, namely the addition amount is weighed as much as 0.5 to 1.0 wt. % larger than the total addition amount in wt. %. Thus, owing to the larger addition amount, the green pellets of the larger size group can be coated satisfactorily and well, on their surface, with the powder cokes by means of second pelletizer 4*a*. In this case, to the powder cokes for coating the green pellets of the larger size group, if appropriate, 0.5 to 1.0 wt. % binder can be added in advance, thereby to allow the powder cokes to stick harder to and coat better the green pellets on their surface.

On the other hand, owing to the less amount of powder cokes initially being allocated to the group of green pellets of smaller size, the amount of powder cokes gets short when the green pellets are coated by second pelletizer 4*b*. But, those green pellets of smaller size are easy to allow heat to reach into their center when sintered. Consequently, throughout sintering process, in spite of the small addition amount of the powder cokes, the green pellets can be well sintered, thanks to aid of surplus amount of powder cokes charged together with the green pellets both of larger and smaller size into a sintering machine. Thus, the shortage in amount of the powder cokes is by no means disadvantageous. In addition, the green pellets of the smaller size group can be easily coated with the powder cokes by mixing without such strong stirring as employed in pelletization. Of course, should it be necessary, the short coating amount of the powder cokes can be made up for as follows:

(a) The green pellets of the smaller size group discharged from second pelletizer 4*b* are allowed to be put together with those of the larger size discharged to a belt-conveyer for transfer.

(b) During the transfer process by the belt-conveyer, the green pellets of the smaller size group are allowed to be given slight vibration and thereby to be further coated with surplus of powder cokes discharged together with the green pellets of the larger size group.

In this embodiment, green pellets are screened into two groups depending on their particle size. Of course, the green pellets can be divided into three groups or more of particle size, to coat the green pellets with powder cokes added. The second pelletizer of disc type used in this embodiment can be also alternated by that of drum type.

EXAMPLE 1

To powdery fine iron ores and coarse grain iron ores, quick limes of 2.7 wt. % as a flux and binder was added and mixed therewith to form a mixture. The obtained mixture was pelletized into green pellets of 3 to 13 mm in particle size with water content of 8 to 9 wt. %. The powdery fine iron ores and coarse grain iron ores were blended so as to allow their ratio of 0.125 mm or less in particle size to be varied. Table 1 shows particle size distribution of the powdery fine iron ores, Table 2 chemical composition of the powdery fine iron ores, Table 3 particle size distribution of the coarse grain iron ores, Table 4 chemical composition of the coarse grain iron ores, Table 5 blend ratio of 0.125 mm or less powdery fine iron ores in particle size composed of the powdery fine and coarse grain iron ores, Table 6 particle size distribution of the quick limes and Table 7 particle size distribution of the green pellets. Next, to the green pellets, powder cokes composed of particle sizes as shown in Table 8 were added and the green pellets were coated, through pelletization, with the powder cokes. Subsequently, the green pellets were charged into an endless grate type sintering machine to be laid in 400 mm thickness on the grate of the sintering machine. The green pellets thus laid, were moved through zones for drying, igniting and sintering in order, to form fired pellets. The large and blocky agglomerates of fired pellets thus formed were discharged from the sintering machine and then crushed by a crusher. The crushed agglomerates of fired pellets were screened to remove those agglomerates less than 3 mm in particle size from the crushed agglomerates. Thus, blocky agglomerates composed of combined fired pellets in plurality with the maximum particle size of about 50 mm, and agglomerates composed of a single fired pellet of 3 to 13 mm in particle size were manufactured. In comparison of Examples of the present invention with Controls, the reduction indexes and the shatter indexes of the manufactured agglomerates of fired pellets are shown in Table 9. Those agglomerates of fired pellets of Test Nos. 1 to 5 as Examples having 30 to 95 wt. % blend ratio of 0.125 mm or less fine iron ores in particle size, all, show good marks of their reduction indexes and shatter indexes. Compared with these results, the other agglomerates of fired pellets of Test Nos. 6 and 7, as Controls, having blend ratios other than 30 to 95 wt. % of 0.125 mm or less fine iron ores show that their reduction indexes and shatter indexes are inferior to those of Test Nos. 1 to 5.

TABLE 1

(wt. %)

| 0.044 mm or less | Over 0.044 mm to 0.125 mm | Over 0.125 mm to 0.5 mm | Over 0.5 mm |
|---|---|---|---|
| 63.86 | 31.07 | 4.48 | 0.59 |

TABLE 2

(wt. %)

| T.Fe | $SiO_2$ | $Al_2O_3$ | CaO | MgO | FeO |
|---|---|---|---|---|---|
| 67.80 | 0.81 | 0.63 | 0.04 | 0.40 | 0.09 |

TABLE 3

| 0.044 mm or less | Over 0.044 mm to 0.125 mm | Over 0.125 mm to 0.50 mm | Over 0.50 mm to 1.00 |
|---|---|---|---|
| 10.07 | 11.88 | 16.92 | 10.75 |
| **Over 1.00 mm to 2.00 mm** | **Over 2.00 mm to 2.83 mm** | **Over 2.83 mm to 8 mm** | **Over 8 mm** |
| 14.36 | 9.41 | 24.14 | 2.47 |

TABLE 4

(wt. %)

| T.Fe | $SiO_2$ | $Al_2O_3$ | CaO | MgO | FeO |
|---|---|---|---|---|---|
| 59.47 | 5.60 | 1.80 | 1.80 | 1.78 | 4.40 |

TABLE 5

| | Test Nos. | Blend Ratio of 0.125 mm or Less (wt. %) |
|---|---|---|
| Examples | 1 | 30 |
| | 2 | 40 |
| | 3 | 60 |
| | 4 | 80 |
| | 5 | 95 |
| Controls | 6 | 20 |
| | 7 | 100 |

TABLE 6

(wt. %)

| 0.125 mm or Less | Over 0.125 mm to 0.5 mm | Over 0.5 mm to 1 mm | Over 1 mm |
|---|---|---|---|
| 16.2 | 20.0 | 18.3 | 45.5 |

TABLE 7

(wt. %)

| 3 mm or More to 5 mm | Over 5 mm to 7 mm | Over 7 mm to 9 mm | Over 9 mm to 10 mm | Over 10 mm to 13 mm |
|---|---|---|---|---|
| 7 | 35 | 39 | 11 | 8 |

TABLE 8

(wt. %)

| 0.1 mm or less | Over 0.1 mm to 0.5 mm | Over 0.5 mm to 1 mm | Over 1 mm |
|---|---|---|---|
| 21.83 | 66.75 | 10.52 | 0.90 |

TABLE 9

| | Test Nos. | Reduction Index (%) | Shatter Index $SI_{+5}$ (%) |
|---|---|---|---|
| Examples | 1 | 76.9 | 85.4 |
| | 2 | 80.7 | 88.3 |
| | 3 | 83.2 | 90.7 |
| | 4 | 85.0 | 91.4 |
| | 5 | 84.2 | 90.6 |
| Controls | 6 | 69.8 | 77.1 |
| | 7 | 84.7 | 80.3 |

EXAMPLE 2

To fine iron ores consisting of 40 wt. % powdery fine iron ores and 60 wt. % coarse grain iron ores, quick limes of 2.7 wt. % as a flux and binder were added and mixed therewith to form a mixture. The obtained mixture was pelletized into green pellets of 3 to 13 mm in particle size with water content of 8 to 9 wt. %. The powdery fine iron ores, the coarse grain iron ores and the quick limes used in Example 2 were same as those used in Example 1 in respect to particle size distribution and chemical composition.

Next, 4 kinds of powder cokes having different blend ratios of particle size of 1 mm or less as shown in Table 10 were used to coat the green pellets. The green pellets were charged into an endless grate type sintering machine to be laid in 400 mm thickness on the grate of the sintering machine. The green pellets thus laid, were moved through zones for drying, igniting and sintering in order, to form agglomerates of fired pellets. In comparison of Examples of the present invention with Controls, the yields, the productivities, the reduction indexes and the reduction degradation indexes of the manufactured agglomerates of fired pellets are shown in Table 11.

Those agglomerates of fired pellets of Test Nos. 8 and 9, as Examples having 80 to 100 wt. % blend ratio of 1 mm or less in particle size show good marks of well more than 75% yields and well over $1.5/T/H/M^2$ productivities. Furthermore, their reduction indexes are well over 80% and their reduction degradation indexes were kept equal to those conventionally practiced. Compared with these results, the other agglomerates of fired pellets of Test Nos. 10 and 11, as Controls, having less than 80 wt. % blend ratio of 1 mm or less in particle size, show poor marks of their yields, of well less than 75% and of their productivities of far less than $1.5T/H/M^2$.

TABLE 10

(wt. %)

| | Test Nos. | 1 mm or less | Over 1 mm to 5 mm | Over 5 mm |
|---|---|---|---|---|
| Examples | 8 | 80 | 20 | — |
| | 9 | 100 | — | — |
| Controls | 10 | 70 | 20 | 10 |
| | 11 | 50 | 30 | 20 |

TABLE 11

| | Test Nos. | Yield (%) | Productivity ($T/H/M_2$) | Reduction Index (%) | Reduction Degradation Index (%) |
|---|---|---|---|---|---|
| Examples | 8 | 76.3 | 1.65 | 83.1 | 22.2 |
| | 9 | 88.6 | 2.03 | 84.4 | 24.3 |
| Controls | 10 | 68.2 | 1.25 | 82.9 | 21.3 |
| | 11 | 63.6 | 1.08 | 83.5 | 22.1 |

EXAMPLE 3

To fine iron ores consisting of 40 wt. % powdery fine iron ores and 60 wt. % coarse grain iron ores, quick limes of 2.7 wt. % as a flux and binder were added and mixed therewith to form a mixture. The obtained mixture was pelletized into green pellets of 3 to 13 mm in particle size with water content of 8 to 9 wt. %. The powdery fine iron ores, the coarse grain iron ores and the quick limes used in Example 3 were same as those used in Example 1 in respect to particle size distribution and chemical composition. The particle size distribution of the prepared green pellets are shown in Table 12.

Subsequently, the the green pellets, 3.5 wt. % powder cokes were added and the green pellets were coated on their surface with the powder cokes by a drum type pelletizer, being followed by checking blend ratios of the coated powder cokes to the green pellets by wt. %. For comparison, green pellets were coated with powder cokes by means of a conventional disc type pelletizer, being followed by checking blend ratios of the coated powder cokes to the green pellets by wt. % as well. Tested powder cokes were of 2 kinds i.e. those of 1 mm or less in particle size and those of 5 mm or less. As the results, blend ratios of coated powder cokes to green pellets by wt. % are shown in Table 13. And then, the green pellets, thus coated with the powder cokes, were charged into an endless grate type sintering machine to be laid in 400 mm thickness on the grate of the sintering machine. The green pellets thus laid, were moved through zones for drying, igniting and sintering in order, to form agglomerates of fired pellets. In comparison of Examples of the present invention with Controls, the yields, the productivities, the reduction indexes and the reduction degradation indexes of the agglomerates of fired pellets are shown in Table 14.

As seen from Table 13, the dispersion of amount of powder cokes coating green pellets of different sizes in each case of Test Nos. 12 and 13 of Examples is less than the dispersion of amount of powder cokes coating green pellets of different sizes in each case of Test Nos. 14 and 15 of Controls. This is because the green pellets for Examples were coated on their surface with powder cokes by means of a drum type pelletizer instead of a disc type pelletizer, which was used to coat the green pellets for Controls with powder cokes. Owing to this, as shown in Table 14, the yields and the productivities of those agglomerates of fired pellets of Test Nos. 12 and 13 as Examples, which were coated with powder cokes by use of a drum type pelletizer are superior to the yields and the productivities of those agglomerates of fired pellets as Controls, which were coated with powder cokes by means of a disc type pelletizer.

TABLE 12

| (wt. %) | | | | | | |
|---|---|---|---|---|---|---|
| 3 mm or less | Over 3 mm to 5 mm | Over 5 mm to 7 mm | Over 7 mm to 9 mm | Over 9 mm to 10 mm | Over 10 mm to 13 mm | Over 13 mm |
| 2 | 6 | 34 | 38 | 10 | 7 | 3 |

TABLE 13

| | Test Nos. | Particle size of Powder Cokes | (wt. %) Particle Size of Green Pellets | | | |
|---|---|---|---|---|---|---|
| | | | 5 mm or less | Over 5 mm to 10 mm | Over 10 mm to 13 mm | Over 13 mm |
| Examples | 12 | 1 mm or | 4.26 | 3.00 | 2.26 | 1.82 |
| | 13 | 5 mm or | 5.89 | 2.44 | 1.64 | 1.24 |
| Controls | 14 | 1 mm or less | 5.14 | 2.84 | 2.19 | 1.16 |
| | 15 | 5 mm or less | 7.12 | 1.89 | 1.36 | 0.80 |

TABLE 14

| | Test Nos. | Yield (%) | Productivities ($T/H/M^2$) | Index (%) | Reduction Index −3 mm (%) |
|---|---|---|---|---|---|
| Examples | 12 | 84.2 | 1.64 | 82.90 | 22.45 |
| | 13 | 76.1 | 1.51 | 87.73 | 23.28 |
| Controls | 14 | 78.2 | 1.55 | 83.47 | 23.20 |
| | 15 | 70.6 | 1.38 | 87.17 | 24.51 |

EXAMPLE 4

To fine iron ores consisting of 40 wt. % powdery fine iron ores and 60 wt. % coarse grain iron ores, quick limes of 0.5 to 5.0 wt. % as a flux and binder were added. Furthermore, limestones as another flux were added so as to control $CaO/SiO_2$ ratio of agglomerates of fired pellets within the range of 1.0 to 2.5. Subsequently, the fine iron ores to which the quick limes and the limestones were mixed and pelletized by a disc type pelletizer into green pellets of 3 to 13 mm in particle size with water content of 8 to 9 wt. %. To the green pellets, 3.5 wt. % powder cokes were further added and the green pellets were coated, through pelletization, with the powder cokes. The powdery fine iron ores, the coarse grain iron ores, the quick limes and the powder cokes used in Example 4 were same as used in Example 1 in respect to particle size distribution and chemical composition.

Next, the green pellets were charged into an endless grate type sintering machine to be laid in 400 mm thick on the grate of the sintering machine. And then, the green pellets were moved through zones for drying, igniting and sintering on the grate in order, to form agglomerates of fired pellets. The yields and the shatter indexes of the manufactured agglomerates of fired pellets are shown in Table 15. As seen from Table 15, the manufactured agglomerates of fired pellets of Test Nos. 16 to 19, as Examples of the present invention, having addition amount of 1.0 to 4.0 wt. % quick limes, maintain the yields of well more than 75% and the shatter indexes of well more than 85%, and this enables to economically manufacture agglomerates of fired pellets with small addition amount of quick limes. In comparison, the manufactured agglomerates of fired pellets of Test No. 20 as one of Controls to which 0.5 wt. % quick limes were added show remarkable deterioration of the yield and the shatter indexes. With respect to the manufactured agglomerates of fired pellets of Test Nos. 21 and 22, as Controls, to which over 2.5 quick limes were added, they show good marks of well over 85% yield and well over 90% shatter indexes, but, owing to large addition amount of the quick limes, they failed to be economically manufactured.

TABLE 15

| | Test Nos. | Addition Amount of Quick Limes (wt. %) | Yield (%) | Shatter Index (%) |
|---|---|---|---|---|
| Examples | 16 | 1.0 | 75.3 | 88.3 |
| | 17 | 1.5 | 78.1 | 90.3 |
| | 18 | 2.0 | 80.5 | 90.6 |
| | 19 | 2.5 | 85.7 | 91.9 |
| Controls | 20 | 0.5 | 62.2 | 83.4 |
| | 21 | 3.0 | 86.0 | 92.2 |
| | 22 | 5.0 | 86.8 | 92.7 |

EXAMPLE 5

To fine iron ores consisting of 50 wt. % powdery fine iron ores and 60 wt. % coarse grain iron ores, quick limes of 2.7 wt. % as a flux and binder were added and mixed therewith to form a mixture. The obtained mixture was pelletized into green pellets of 3 to 13 mm in particle size with water content of 8 to 9 wt. %. The powdery fine iron ores, the coarse grain iron ores and the quick limes used in Example 5 were same as those used in Example 1 in respect to particle size distribution and chemical composition.

Next, the green pellets thus obtained, were screened into those of 5 mm or less in particle size and those over 5 mm, and those of 5 mm or less and those over 5 mm, each were blended as shown in Table 16. To those green pellets, 3.5 wt. % powder cokes having the same particle size distribution as those of Example 1 were added and, those green pellets were coated, through pelletization, with the powder cokes on the surface. Subsequently, the green pellets were charged into an endless grate type sintering machine to be laid in 400 mm thickness on the grate of the sintering machine. And then, the green pellets were moved on the grate, through zones for drying, igniting and sintering in order, to form agglomerates of fired pellets. The yields, the productivities and the shatter indexes of the manufactured agglomerates of fired pellets are shown in Table 17.

As seen from Table 17, those agglomerates of fired pellets of Test Nos. 23 to 26, as Examples of the present invention, having 15 to 40 wt. % blend ratio of 5 mm or less particle sizes, show good marks of well more than 75% yields, 1.5 $T/H/M^2$ level or more productivities, and well more than 90% shatter indexes. Compared with these results, the manufactured agglomerates of fired pellets of Test No. 27, as one of Controls, having 10 wt. % or less blend ratio of 5 mm or less particle size show its yield being inferior to those yield ratios of the agglomerates of fired pellets of Test Nos. 23 to 26. The manufactured agglomerates of fired pellets of Test No. 28 as Controls marks its productivity being inferior to Test Nos. 23 to 26 of Examples.

TABLE 16

| | Test Nos. | (wt %) Particle Size of 5 mm or less | Particle Size Over 5 mm |
|---|---|---|---|
| Exmples | 23 | 15 | 85 |
| | 24 | 20 | 80 |
| | 25 | 30 | 70 |
| | 26 | 40 | 60 |
| Controls | 27 | 10 | 90 |
| | 28 | 50 | 50 |

TABLE 17

| | Test Nos. | Yield (%) | Productivity ($T/H/M^2$) | Shatter Index $ST_{+5}$ (%) |
|---|---|---|---|---|
| Examples | 23 | 77.5 | 1.66 | 92.7 |
| | 24 | 83.4 | 1.78 | 92.3 |
| | 25 | 80.7 | 1.77 | 90.9 |
| | 26 | 83.3 | 1.47 | 90.7 |
| Controls | 27 | 72.5 | 1.65 | 94.5 |
| | 28 | 85.2 | 1.32 | 87.2 |

EXAMPLE 6

5 kinds of fine iron ores composed of particle size distribution as shown in Table 18(a) and chemical composition as shown in Table 18(b), each, were blended as shown in Table 19 so as to allow $SiO_2$ amount contained in each of the fine iron ores to range 0.5 to 6.0 wt. %. Subsequently, to these fine iron ores thus blended, quick limes as a flux and binder, and limestones as a regulator of basicity, were added and mixed with the fine iron ores. The amount of the quick limes ranged 1.0 to 2.7 wt. %, and the basicity was regulated in the range of 1.8 to 2.2. The mixture of the fine iron ores with the quick limes and the limestones were pelletized, by means of a disc type pelletizer, into green pellets of 3 to 13 mm in particle size with water content of 8 to 9 wt. %. Subsequently, to the green pellets, 3.5 wt. % powder cokes were added, and the green pellets were coated, through pelletization, with the powder cokes. The quick limes and the powder cokes used in Example 6 were same as those used in Example 1 in respect to particle size distribution and chemical composition. Next, the green pellets were charged into an endless grate type sintering machine to be laid in 400 mm thickness on the grate of the sintering machine, and then, were moved through zones for drying, igniting and sintering in order, to form agglomerates of fired pellets. The $SiO_2$ contents in the manufactured agglomerates of fired pellets, the yields, the shatter indexes, the reduction indexes and the reduction degradation indexes of the manufactured agglomerates of fired pellets are shown in Table 20. As seen from Table 20, manufactured agglomerates of fired pellets of Test Nos. of 29 to 34, as Examples of the present invention having 0.5 to 5.0 wt. % $SiO_2$ content contained in the agglomerates of fired pellets, all, showed good marks of their reduction indexes and reduction degradation indexes. Contrarily, the manufactured agglomerates of fired pellets of Test Nos. 35 and 36, as Controls, having over 5.0 wt. % $SiO_2$ content contained in the agglomerates of fired pellets, deteriorated their reduction indexes and reduction degradation indexes, although their shatter indexes and yields were good.

TABLE 18 (a)

| | | 0.044 mm or less | Over 0.044 mm to 0.125 | Over 0.125 mm to 0.5 | Over 0.5 mm to 1.0 | Over 1.0 mm to 2.83 | Over 2.83 to 4.76 | Over 4.76 mm |
|---|---|---|---|---|---|---|---|---|
| Powdery Fine | A | 66.17 | 31.04 | 2.79 | — | — | — | — |

TABLE 18 (a)-continued

| | | 0.044 mm or less | Over 0.044 mm to 0.125 | Over 0.125 mm to 0.5 | Over 0.5 mm to 1.0 | Over 1.0 mm to 2.83 | Over 2.83 to 4.76 | Over 4.76 mm |
|---|---|---|---|---|---|---|---|---|
| Iron Ores | B | 41.57 | 52.15 | 5.97 | 0.31 | — | — | — |
| Coase | C | 5.27 | 11.76 | 33.51 | 24.08 | 21.07 | 4.13 | 0.18 |
| Grain | D | 4.17 | 12.36 | 32.62 | 18.19 | 31.52 | 1.03 | 0.11 |
| Iron Ores | E | 4.24 | 11.61 | 30.08 | 16.72 | 33.46 | 3.75 | 0.14 |

TABLE 18 (b)

| | (wt. %) | | | | | |
|---|---|---|---|---|---|---|
| | Fe | $SiO_2$ | $Al_2O_3$ | CaO | MgO | FeO |
| A | 68.32 | 0.28 | 0.73 | 0.04 | 0.13 | 0.14 |
| B | 62.57 | 5.53 | 2.26 | 0.04 | 0.06 | 0.16 |
| C | 68.24 | 0.57 | 0.80 | 0.04 | 0.05 | 0.14 |
| D | 58.04 | 6.91 | 2.18 | 1.74 | 2.03 | 6.93 |
| E | 58.29 | 5.32 | 2.26 | 1.46 | 1.23 | 7.01 |

TABLE 19

| | Test Nos. | Blend ratio of Fine Iron Ores (wt. %) A | B | C | D | E | $SiO_2$ Content in Fine Iron Ores (wt. %) |
|---|---|---|---|---|---|---|---|
| Examples | 29 | 70 | — | 27 | — | 3 | 0.48 |
| | 30 | 70 | — | 20 | 5 | 5 | 0.98 |
| | 31 | 70 | — | — | 15 | 15 | 2.07 |
| | 32 | 60 | — | — | 40 | — | 2.88 |
| | 33 | 40 | 20 | — | 40 | — | 4.03 |
| | 34 | 20 | 40 | — | 40 | — | 5.10 |
| Controls | 35 | 10 | 50 | — | 30 | 10 | 5.54 |
| | 36 | — | 60 | — | 40 | — | 6.02 |

TABLE 20

| | Test Nos. | $SiO_2$ Content (%) | Yield (%) | Shatter Index $SI_{+5}$ (%) | Reduction Index (%) | Reduction Degradation Index (%) |
|---|---|---|---|---|---|---|
| Examples | 29 | 0.52 | 78.0 | 87.4 | 89,3 | 25.6 |
| | 30 | 1.12 | 82.1 | 89.8 | 87.8 | 22.1 |
| | 31 | 2.23 | 80.9 | 92.7 | 88.2 | 20.6 |
| | 32 | 3.07 | 84.6 | 90.6 | 85.5 | 23.4 |
| | 33 | 4.10 | 85.4 | 92.3 | 86.0 | 23.9 |
| | 34 | 4.96 | 83.0 | 90.9 | 82.2 | 26.0 |
| Controls | 35 | 5.74 | 86.5 | 91.0 | 76.1 | 33.7 |
| | 36 | 6.11 | 84.7 | 91.3 | 73.6 | 32.8 |

EXAMPLE 7

To powdery fine iron ores and coarse grain iron ores, 2.7 wt. % quick limes, as a flux and binder, were added, and mixed therewith to form a mixture. The mixture was pelletized into green pellets of 3 to 13 mm in particle size with water content of 8 to 9 wt. %. The powdery fine iron ores and the coarse grain iron ores were blended so as to allow their blend ratios of particle sizes of 0.044 mm or less to be varied. The blend ratios of 0.044 mm or less particle sizes are shown in Table 21. Subsequently, to the green pellets, 3.5 wt. % powder cokes were added and the green pellets were coated, through pelletization, with the powder cokes. The powdery fine iron ores, the coarse grain iron ores, the quick limes and the powder cokes used in Example 7 were same as used in Example 1 in respect to particle size distribution and chemical composition.

Next, the green pellets were charged into an endless grate type sintering machine to be laid in 400 mm thickness on the grate of the machine and then, were moved through zones for drying, igniting and sintering in order, to form agglomerates of fired pellets. The reduction indexes and the shatter indexes of the manufactured fired pellets are shown in Table 22. The manufactured agglomerates of fired pellets of Test Nos. 37 to 41, as Examples of the present invention, having 10 to 80 wt. % blend ratio of particle sizes of 0.44 mm or less, all, mark high reduction indexes and shatter indexes. The manufactured agglomerates of fired pellets having of Test No. 42, as one of Controls, having 5% blend ratio of 0.044 mm or less in particle size, show its reduction index being low. The manufactured agglomerates of fired pellets of Test Nos. 43 and 44, as Controls, having 90 and 100 wt. % blend ratios of particle size of 0.044 mm or less show low shatter indexes.

TABLE 21

| | Test Nos. | Blend Ratio of 0.044 mm or Less in Particle Sizes (wt %) |
|---|---|---|
| Examples | 37 | 10 |
| | 38 | 20 |
| | 39 | 40 |
| | 40 | 60 |
| | 41 | 80 |
| Controls | 42 | 5 |
| | 43 | 90 |
| | 44 | 100 |

TABLE 22

| | Test Nos. | Reduction Index (%) | Shatter Index $SI_{+5}$ (%) |
|---|---|---|---|
| Examples | 37 | 76.3 | 86.2 |
| | 38 | 82.5 | 90.4 |
| | 39 | 86.6 | 92.1 |
| | 40 | 85.1 | 91.3 |
| | 41 | 87.1 | 93.3 |
| Controls | 42 | 70.2 | 76.8 |
| | 43 | 85.4 | 82.7 |
| | 44 | 86.1 | 74.4 |

EXAMPLE 8

To fine iron ores consisting of 40 wt. % powdery fine iron ores and 60 wt. % coarse grain iron ores, 2.7 wt. % quick limes, as a flux and, binder, were added and mixed therewith to form a mixture. The mixture thus obtained, were pelletized into green pellets of 3 to 13 mm in particle size with water content of 8 to 9 wt. %. The powdery fine iron ores, the coarse grain iron ores and the quick limes used in Example 8 were same as those used in Example 1 in respect to particle size distribution and chemical composition.

Next, to the green pellets, 5 kinds of powder cokes having different blend ratios or particle sizes of 1 mm or less as shown in Table 23 were added and used to coat the green pellets. The green pellets were charged into an endless grate type sintering machine to be laid in 400 mm thickness on the grate of the sintering machine, and then, were moved through zones for drying, igniting and sintering in order, to form agglomerates of fired pellets. The yields, the productivities, the reduction indexes and the reduction degradation indexes of the manufactured agglomerates of fired pellets are shown in Table 24.

The manufactured agglomerates of fired pellets of Test Nos. 45 to 47, as Examples of the present inventions, having 20 to 70 wt. % blend ratios of 0.1 mm or less particle sizes, show good marks of well more than 75% yield and of well over 1.5 $T/H/M^2$ productivity. Their reduction indexes were well more than 80% and their reduction degradation indexes well less than 25%, being maintained almost equal to the values conventionally practiced. In comparison, the manufactured agglomerates of fired pellets of Test Nos. 48 and 49, as controls, having less 20 wt. % blend ratios of 0.1 mm or less particle size show poor marks of less than 75% yield and of less 1.5 $T/H/M^2$ productivity.

TABLE 23

| | Test Nos. | (wt.%) 1 mm or less | Over 1 mm to 5 mm | Over 5 mm |
|---|---|---|---|---|
| Examples | 45 | 20 | 80 | — |
| | 46 | 50 | 50 | — |
| | 47 | 70 | 30 | — |
| Controls | 48 | 10 | 60 | 30 |
| | 49 | — | 60 | 40 |

TABLE 24

| | Test Nos. | Yield (%) | Productivity ($T/H/M_2$) | (wt. %) Reduction Index (%) | Reduction Degradation Index (%) |
|---|---|---|---|---|---|
| Examples | 45 | 78.8 | 1.81 | 82.9 | 19.8 |
| | 46 | 83.5 | 1.92 | 83.5 | 23.0 |
| | 47 | 88.2 | 2.01 | 83.8 | 22.5 |
| Controls | 48 | 68.0 | 1.37 | 83.0 | 28.1 |
| | 49 | 55.2 | 1.12 | 80.7 | 21.1 |

EXAMPLE 9

To fine iron ores consisting of 40 wt. % powdery fine iron ores and of 60 wt. % coarse grain iron ores, 2.7 wt. % quick limes were added and mixed therewith to form a mixture. The mixture thus obtained, were pelletized into green pellets of 3 to 13 mm in particle size with water content of 8 to 9 wt. %. The powdery fine iron ores, the coarse grain iron ores and the quick limes used in this Example were same as those used in Example 1 in respect to particle size distribution and chemical composition. Subsequently, powder cokes, which quick limes, as binder, had been added to and mixed with in advance, were added to the green pellets by 3.5 wt. %, and then, the green pellets were coated on the surface with the powder cokes, being followed by checking of blend ratio of the powdered cokes to the green pellets by wt. %. The particle size distribution of the quick limes added to the powder cokes are as shown in Table 25. With respect to the addition amount of the quick limes to the powder cokes, the two ratios of 0.5 wt. % and 1.0 wt. % were tested. Further, with respect to the powder cokes, the two kinds of powder cokes A whose particle size was comparatively coarse, and powder cokes B whose particle size was comparatively fine, respectively as shown in Table 26, were tested. For comparison, powder cokes without addition of quick limes were coated with on the surface of the green pellets, being followed by checking blend ratios of powder cokes to green pellets by wt. % as well. Blend ratio of powder cokes to green pellets by wt. % are shown in Table 27. Next, the green pellets were charged into an endless grate type sintering machine to be laid in 400 mm thickness on the grate of the sintering machine, and then, were moved through zones for drying, igniting and sintering in order, to form agglomerates of fired pellets. The yields and the productivities of the manufactured agglomerates of fired pellets are shown in Table 28.

As shown in Table 27, in Test Nos. of 50 to 53, as Examples of the present invention, wherein powder cokes to and with which quick limes were added and mixed in advance were used, any of blend ratios of powder cokes to green pellets are high, showing that the green pellets were well coated with the powder cokes, although the blend ratios made a slight difference, depending on the particle size features of powder cokes A (relatively coarse) and powder cokes B (relatively fine). Thanks to this, as seen from Table 28, in Test Nos. of 50 to 53, the yields and the productivities of the obtained agglomerates of fired pellets get higher than those of the agglomerates of fired pellets obtained from Test Nos. of 54 and 55 as Controls. In addition, Test Nos. 50 and 52 give examples wherein powder cokes coarse enough to be unfitted for coating green pellets were used. In comparison, in Test Nos. 54 and 55 wherein power cokes were used without addition of quick limes as shown in Table 27, any of the blend ratios of powder cokes to green pellets by wt. % is low, showing that the green pellets were not well coated with the powder cokes. Due to this, as seen from Table 28, in Test Nos. 54 and 55, the yields and the productivities are low.

TABLE 25

| 0.125 mm or less | Over 0.125 mm to 0.5 mm | Over 0.5 mm to 1 mm | (wt. %) Over 0.5 mm |
|---|---|---|---|
| 21.4 | 38.2 | 24.9 | 15.5 |

TABLE 26

| | 0.1 mm or less | Over 0.1 mm to 0.5 mm | Over 0.5 mm to 1 mm | (wt. %) Over 1 mm to 5.0 mm | Over 5 mm |
|---|---|---|---|---|---|
| A | 17.0 | 32.9 | 17.0 | 30.2 | 2.9 |
| B | 31.2 | 29.3 | 13.5 | 26.0 | 0 |

TABLE 27

| Test Nos. | | Quick limes' Addition Amount | Features of Powder Cokes | (wt. %) Powder Cokes' Amount Coating Green Pellets in Different Particle Sizes: 5 mm or less | Over 5 mm to 10 mm | Over 10 mm to 13 mm | Over 13 mm |
|---|---|---|---|---|---|---|---|
| Examples | 50 | 0.5 | A | 5.90 | 2.60 | 1.88 | 1.33 |
| | 51 | 0.5 | B | 5.43 | 2.91 | 2.48 | 1.88 |
| | 52 | 1.0 | A | 6.01 | 2.55 | 1.92 | 1.41 |
| | 53 | 1.0 | B | 5.66 | 3.03 | 2.44 | 1.91 |
| Controls | 54 | — | A | 8.77 | 1.90 | 1.02 | 0.61 |
| | 55 | — | B | 5.89 | 2.72 | 2.19 | 1.76 |

TABLE 28

| | Test Nos | Yield (%) | Productivity ($T/H/M^2$) |
|---|---|---|---|
| Examples | 50 | 77.6 | 1.59 |
| | 51 | 82.1 | 1.70 |
| | 52 | 77.0 | 1.55 |
| | 53 | 83.4 | 1.68 |
| Controls | 54 | 69.1 | 1.23 |
| | 55 | 79.2 | 1.63 |

EXAMPLE 10

To fine iron ores consisting of 40 wt. % powdery fine powder iron ores and 60 wt. % coarse grain iron ores, quick limes of 2.7 wt. % were added and mixed therewith to form a mixture. The mixture thus obtained, were pelletized into green pellets of 3 to 13 mm in particle size with water content of 8 to 9 wt. %. Subsequently, the green pellets were screened into two groups i.e. one group of green pellets of 3 to 7 mm in particle size and another group of those of over 7 to 13 mm. And then, powder cokes were added separately in amount as much as shown in Table 29 to green pellets of each of the two groups so as to allow the added amount, by means of weighing, to the larger size group to be more than to the smaller size group, and the green pellets were coated on their surfaces, through pelletization by a disc type pelletizer, with the powder cokes. For comparison, to the green pellets of the larger size group and to those of the smaller size group power cokes were added without weighting, and the green pellets of each of the groups. The powdery fine iron ores, the coarse grain iron ores, the quick limes and the powder cokes used Example 10 were same as those used in Example 1. Blend ratios of powder cokes to green pelelts were checked, and the results are shown in Table 30. Next, the green pellets were charged into an endless grate type sintering machine to be laid in 400 mm thickness on the grate of the sintering machine, and then, were transfered through the drying, igniting and sintering zone in order, to sinter agglomerates of fired pellets. The yields and productivity of the obtained fired pellets are shown in Table 31.

As seen from Table 30, in Test Nos. 56 and 57 as Examples of the present invention, powder cokes were added so as to allow the addition amount, by weighing, to the green pellets of the over 7 to 13 mm to be larger size group, and consequently, the blend ratios of the powder cokes to the larger size green pellets by wt. % becomes larger. That is to say, the larger size green pellets whose coating must be taken care of were well coated with the powder cokes. Thanks to this, as shown in Table 31, the yields and the productivities of the obtained agglomerates of fired pellets of Test Nos. 56 and 57 as Examples of the present invention, attain good marks.

In comparison, as seen from Table 30, in Test Nos. 58 and 59, as Control, powder cokes were added to the green pellets without weighing, the blend ratios of the larger size green pellets are lower, i.e. the larger size green pellets whose coating must be taken care of are coated with the powder cokes in small amount. Due to this, the yields as well as the productivities of the manufactured agglomerates fired pellets in Test Nos. 58 and 59 are found only to be of low marks, as shown in Table 31.

TABLE 29

| | Test Nos. | Powder Cokes Addition in Screened Groups: 3 mm or More to 7 mm | Over 7 to 13 mm | Total Addition Amount (wt. %) |
|---|---|---|---|---|
| Examples | 56 | 1.6 | 4.0 | 3.0 |
| | 57 | 2.6 | 5.0 | 4.0 |
| Controls | 58 | 3.0 | 3.0 | 3.0 |
| | 59 | 4.0 | 4.0 | 4.0 |

TABLE 30

| | Test Nos. | 3 mm or More to 7 | Over 7 to 13 mm |
|---|---|---|---|
| Examples | 56 | 1.57 | 3.05 |
| | 57 | 2.55 | 3.88 |
| Controls | 58 | 2.95 | 2.04 |
| | 59 | 3.93 | 2.97 |

TABLE 31

| | Test Nos. | Yield (%) | Productivity ($T/H/M^2$) |
|---|---|---|---|
| Examples | 56 | 83.44 | 1.66 |
| | 57 | 87.98 | 1.71 |
| Controls | 58 | 73.13 | 1.35 |
| | 59 | 79.62 | 1.47 |

What is claimed is:

1. A method for manufacturing agglomerates of fired particles comprising the steps of:

adding quick limes to fine iron ores in an amount of 1.0 to 2.5 weight % based on the weight of fine iron ores, 30 to 95 weight % of the fine iron ores having a particle size of 0.125 mm or less;

mixing the quick limes and fine iron ores to produce a mixture;

pelletizing the mixture to form green pellets;

adding powder cokes to the green pellets in an amount of 2.5 to 4.0 weight % based on the weight of fine iron ores in the green pellets, 80 to 100 % by weight of the powder cokes having a particle size of 1 mm or less;

pelletizing the green pellets and the powder cokes using a drum type pelletizer to produce green pellets coated with the powder cokes;

charging the coated green pellets into a grate type sintering machine; and sintering the coated green pellets to produce agglomerates of fired pellets containing 0.5 to 5.0 weight % $SiO_2$.

2. The method of claim 1, wherein 50 to 95 weight % of the fine iron ores have a particle size of 0.125 mm or less.

3. The method of claim 1, wherein 15 to 40 % by weight of the green pellets produced by pelletizing the mixture of quick limes and fine iron ores have a particle size of 5 mm or less, and the remainder of the green pellets have a particle size greater than 5 mm.

4. The method of claim 1, wherein 90 to 100 weight % of the powder cokes have a particle size of 1 mm or less.

5. A method for manufacturing agglomerates of fired pellets comprising the steps of:

adding quick limes to fine iron ores in an amount of 1.0 to 2.5 weight % based on the weight of fine iron ores, 10 to 80 % of the fine iron ores having a particle size of 0.044 mm or less;

mixing the quick limes and fine iron ores to produce a mixture;

pelletizing the mixture to form green pellets;

adding powder cokes to the green pellets in an amount of 2.5 to 4.0 weight % based on the weight of fine iron ores in the green pellets, 20 to 70 % by weight of the powder cokes having a particle size of 1 mm or less;

pelletizing the green pellets and the powder cokes using a drum type pelletizer to produce green pellets coated with powder cokes;

charging the coated green pellets into a grate type sintering machine; and sintering the coated green pellets to produce agglomerates of fired pellets containing 0.5 to 5.0 weight % $SiO_2$.

6. The method of claim 5, wherein 30 to 80 weight % of the fine iron ores have a particle size of 0.044 mm or less.

7. The method of claim 5, wherein 15 to 40 weight % of the green pellets have a particle size of 5 mm or less, and the remainder of the green pellets have a particle size of greater than 5 mm.

8. The method of claim 5, wherein 40 to 70 weight % of the powder cokes have a particle size of 1 mm or less.

9. A method for manufacturing agglomerates of fired particles comprising the steps of:

adding fluxes to fine iron ores and mixing the fluxes and fine iron ores to produce a mixture;

pelletizing the mixture to form green pellets;

adding a binder to powder cokes in an amount of 0.1 to 1.0 weight % based on the weight of the powder cokes and mixing the binder and the powder cokes;

pelletizing the green pellets and the powder cokes mixed with the binder to produce green pellets coated with powder cokes;

charging the coated green pellets into a grate type sintering machine; and sintering the coated green pellets to produce agglomerates of fired pellets containing 0.5 to 5.0 weight % $SiO_2$.

10. The method of claim 9, wherein the binder is at least one member selected from the group consisting of quick limes, slacked limes, bentonite, dolomite and blast furnace water-granulated slag.

11. The method of claim 9, wherein the green pellets and the powder cokes mixed with the binder are pelletized using a drum type pelletizer.

12. The method of claim 9, wherein the step of adding fluxes to fine iron ores comprises adding quick limes in an amount of 1.0 to 2.5 weight %, based on the weight of fine iron ores, to the fine iron ores.

13. The method for manufacturing agglomerates of fired pellets comprisng the steps of:

adding fluxes to fine iron ores and mixing the fluxes and fine iron ores to produce a mixture;

pelletizing the mixture into green pellets;

screening the green pellets into at least two separate groups according to particle size;

separately adding powder cokes to each of the at least two groups of screened green pellets and pelletizing the at least two groups of screened green pellets and powder cokes to produce at least two separate groups of green pellets coated with powder cokes, the powder cokes being added to the at least two group of screened green pellets such that a larger proportion by weight of powder cokes is added to green pellets having a larger particle size;

charging the at least two groups of green pellets coated with powder cokes into a grate type sintering machine; and sintering the green pellets coated with powder cokes into agglomerates of fired pellets.

14. The method of claim 13, wherein the green pellets include green pellets having a particle size of 3 to 13 mm.

15. The method of claim 13, wherein the step of screening the green pellets into at least two groups includes screening the green pellets into a first group of green pellets having a particle size of 3 to 7 mm and a second group of green pellets having a particle size of over 7 to 13 mm.

16. The method of claim 13, wherein powder cokes are added in an amount of 2.5 to 4.0 % by weight based on the total weight of the green pellets, and wherein 0.5 to 1.0 weight % more than the amount of 2.5 to 4.0 weight % of powder cokes, based on the total weight of the green pellets, is added to the group of screened green pellets having a larger particle size.

* * * * *